United States Patent [19]

Boyer

[11] 4,214,782

[45] Jul. 29, 1980

[54] COVER LATCH

[76] Inventor: Bernard Boyer, 17 Fulton Ave., Waukegan, Ill. 60085

[21] Appl. No.: 87

[22] Filed: Jan. 2, 1979

[51] Int. Cl.[2] ..... B65D 45/22; E05C 19/06

[52] U.S. Cl. ..... 292/87; 220/326

[58] Field of Search ..... 220/326, 323; 292/87, 292/89, 88, 80, 19

[56] References Cited

U.S. PATENT DOCUMENTS

| | | | |
|---|---|---|---|
| 1,961,223 | 6/1934 | Jamison | 292/80 X |
| 2,039,764 | 5/1936 | Barth | 292/87 X |
| 2,220,318 | 5/1940 | Curtis | 292/87 X |
| 2,220,319 | 11/1940 | Curtis | 292/87 X |
| 2,315,455 | 3/1943 | Sale | 220/323 |
| 2,632,580 | 3/1953 | Biddlecombe . | |
| 2,756,084 | 7/1956 | Fraser | 292/87 |
| 2,974,990 | 3/1961 | Mereness . | |
| 3,112,133 | 11/1963 | Huber et al. | 292/87 |

*Primary Examiner*—Allan N. Shoap

*Attorney, Agent, or Firm*—Merriam, Marshall & Bicknell

[57] ABSTRACT

A releasable latch for a garbage can cover which includes a stop member affixed to the depending flange of the garbage can cover and a resilient latch member affixed to the depending flange of the cover at a point thereon diametrically opposite the stop member. The resilient latch member has a resilient latch arm with a latch element normally extending inwardly through an opening formed in the depending flange of the cover. The stop member and the latch element are adapted to engage the lower edge of the conventional outwardly turned rim formed on the upper end of the garbage can when the cover is moved upwardly. The latch element has a camming surface which moves the latch arm outwardly while the cover is being placed in closed position on the can. A finger grip is provided on the resilient arm to move the latch element outwardly out of contact with the rim to permit removing the cover from the can.

3 Claims, 9 Drawing Figures

FIG. 1
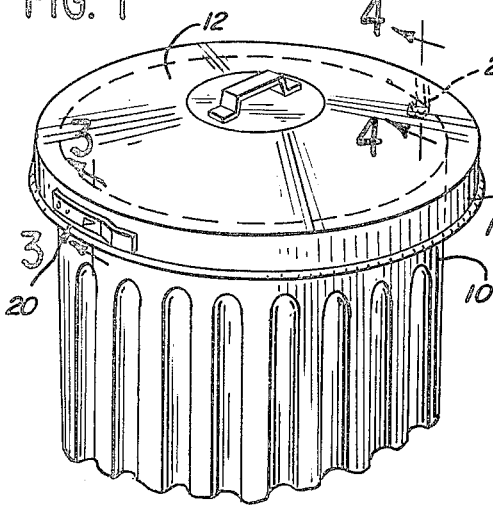
FIG. 3
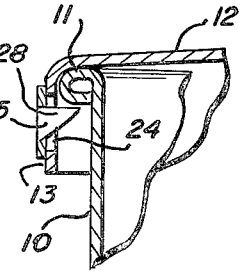
FIG. 4
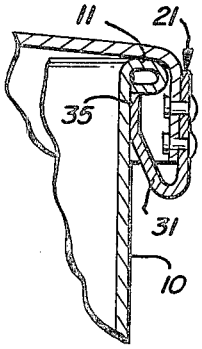
FIG. 2A
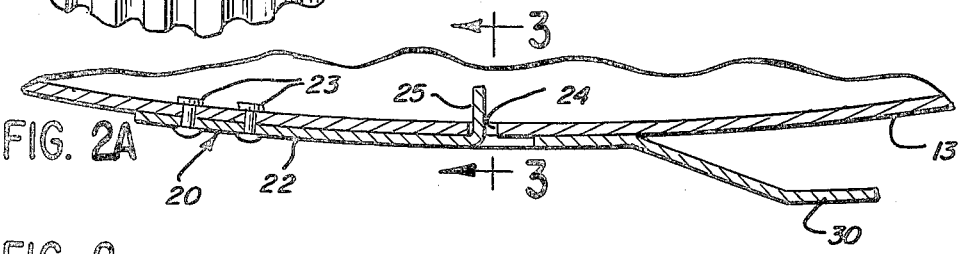
FIG. 2
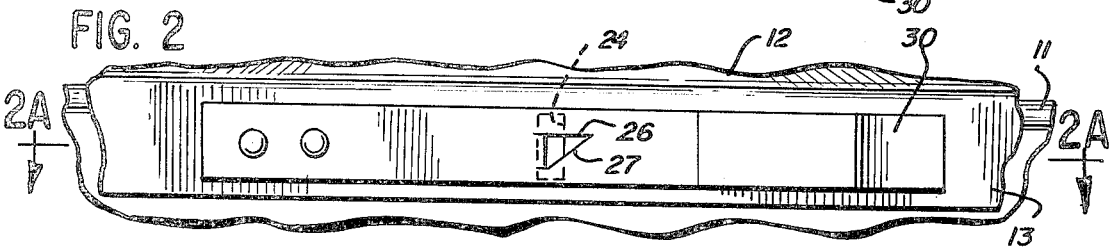
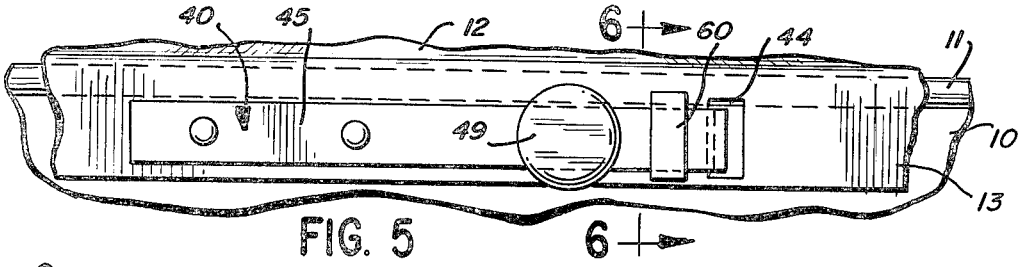
FIG. 5
FIG. 6
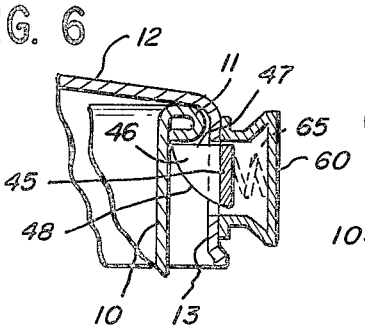
FIG. 7
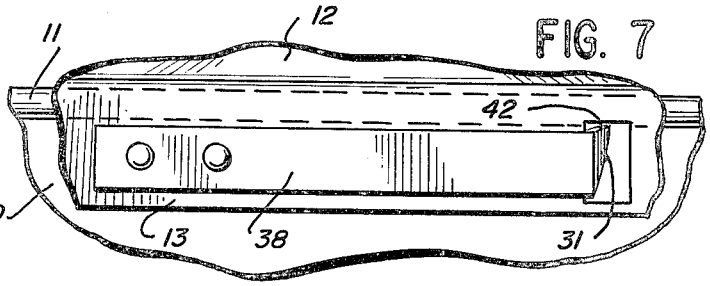
FIG. 8
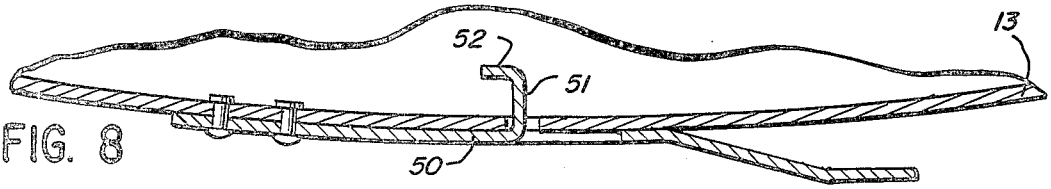

COVER LATCH

The present invention relates generally to a container closure latching means and more particularly to an improved latch structure for releasably holding a cover on a garbage can or like container.

It is an object of the present invention to provide a more reliable and less expensive means for releasably holding a cover on a container, such as a garbage can, which has an outwardly turned rim on the uppermost edge thereof and a cover of the type having a depending circumferential flange which extends downwardly over the rim of the container.

It is a further object of the invention to provide a garbage can cover latch structure which can be operated with one hand and which is permanently secured to the cover so that the latching means cannot become separated or lost during use.

Other objects of the invention will be apparent from the detailed description and claims to follow when read in conjunction with the accompanying drawing, wherein:

FIG. 1 is a fragmentary perspective view of a garbage can and cover having the improved latching means of the present invention mounted thereon;

FIG. 2 is an enlarged fragmentary elevational view of the latching means of FIG. 1;

FIG. 2A is a horizontal sectional view along the lines 2A—2A of FIG. 2;

FIG. 3 is a vertical sectional view along the lines 3—3 of FIG. 2A;

FIG. 4 is a fragmentary vertical sectional view of a stop member in operative position which is used in FIG. 1;

FIG. 5 is a fragmentary elevational view of a modified form of latch means of the present invention;

FIG. 6 is a fragmentary vertical sectional view taken along the lines 6—6 of FIG. 5;

FIG. 7 is a fragmentary perspective view of the modified form of the stop element used in the present invention; and FIG. 8 is a fragmentary horizontal sectional view of a further modified form of latch means of the present invention.

As illustrated in FIGS. 1–4, a conventional garbage can 10 having an outwardly rolled rim 11 at the uppermost edge thereof is provided with a conventional cover 12 which has a depending circumferential flange 13 extending downwardly over the rim 11 and closing the can 10. A cover handle 14 can be attached to the cover 12 in the usual manner.

In the preferred form of cover latching means shown in FIGS. 1–4, a resilient latch means 20 is secured to the depending flange 13 of the cover 12 and a stop member 21 is secured to the flange 13 at a point diametrically opposite the latch means 20 so as to detachably hold the cover 12 on the can 10 and prevent accidental removal of the cover 10. The resilient latch means 20 is preferably formed of a leaf-type spring latch member or resilient arm 22, preferably formed of spring steel about 0.040 inches thick, which is fixedly secured to the outer surface of the cover flange 13 by any suitable means, such as spot welding, rivets or bolts 23, with the resilient arm 22 extending generally parallel with the lower edge of the cover 12. A latch element 25 is preferably integrally formed with the resilient arm 22 intermediate the edges thereof by cutting through the arm 22 along the longitudinally extending cut-out edge 26 and along the downwardly extending cut-out edge 27 and bending the cut-out section inwardly until it forms an angle of 90° with the plane of the arm 22, to form the latch element 25 which is adapted to extend inwardly through an opening 24 formed in the flange 13. The position of the latch element 25 on the flange 13 and the length of the cut-out section is such that the upper horizontal edge 28 of the latch element 25 will engage the lower surface of the rim 11 when the cover 12 is moved vertically upwardly from its closed position. The lower edge 29 of the latch element 25 is formed so as to provide a camming surface to effect outwardly movement of the resilient arm 22 when the cover 12 is moved downwardly over the rim 11 of the can 10 into closed position.

The portion of the resilient arm 22 which extends beyond the cut-out portion is bent outwardly at an angle of about 45° for a short distance and then bent inwardly so that the end section 30 is spaced sufficiently from the flange 13 to permit a user's fingers engaging the inner surface thereof and effecting outward movement of the resilient arm 22 a distance sufficient to disengage the latch element 25 from the rim 11 when it is desired to remove the cover 12 from the can 10.

The stop member 21 which is secured to the flange 13 at a point diametrically opposite the latch means 20, as best shown in FIG. 4, is formed of a generally U-shaped resilient or rigid strip 31 with the outer upstanding leg secured to the outer surface of the flange 13 and the inner upstanding leg extending inwardly and upwardly from the lower edge of the flange 13 so that the upper end 35 of the inner leg is adapted to engage the lower edge of the rim 11 when the cover 12 is moved vertically upwardly from closed position.

If desired, the stop member 21 can be in the form shown in FIG. 7 comprising a resilient arm 38 having the outer end thereof bent inwardly in a 90° angle to form a resilient stop element 41 which extends inwardly through a slot 44 cut through the flange 13. The upper horizontal surface 42 of the stop element 41 is adapted to engage the lower edge of the rim 11 when the cover 12 is moved vertically upwardly from the closed position. The inner edge of the inwardly turned end portion is preferably in the form of a camming surface which effects movement of the arm 38 outwardly when the cover is moved downwardly over the rim 11 into closed position.

In the modified form of the resilient latch means shown in FIGS. 5 and 6, the latch means 40 is formed of a spring biased latch member or resilient arm 45 secured at the inner end to the flange 13 and having the outer end bent inwardly at an angel of about 90° with the plane of the latch arm 45 to form a latch element 46 which extends through an opening 50 formed in the flange 13 so that the upper edge 47 thereof engages the lower edge of the rim 11 when the cover is moved upwardly from closed position. The inner edge 48 of the latch element 46 is preferably provided with a downwardly and outwardly curved camming surface which effects movement of the arm 45 outwardly when the cover 10 is moved downwardly over the rim 11. The arm 45 has a knob 49 extending outwardly adjacent the outer end thereof which is adapted to be engaged by the operator's fingers to effect movement of the arm 45 outwardly so that the inner end of the latch element 46 disengages from the rim 11 when the user desires to remove the cover 12 from the can 10.

As indicated in FIG. 6, a guard or handle 60 can be affixed to the depending flange 13 so as to limit the outwardly movement of the resilient latch arm 45 during removal of the cover from the container. The guard 60 is spaced from the resilient latch arm 45 a distance which will allow the latch element 46 to be moved outwardly and be disengaged from the rim 11 of the can 10, permitting the cover 12 to be removed by upwardly vertical movement of the cover 12. If desired, a coil spring 65 (shown in dotted line) can be interposed between the inner wall of the guard 60 and the outer surface of the arm 45 to provide all or part of the resiliency required to maintain the latch element 46 normally extending inwardly.

In the modified form of the resilient arm 50 shown in FIG. 8, the inner end of the latch element 51 is provided with a stop member 52 in the form of an end flange extending perpendicular to the plane of the latch element 51 which is adapted to engage the inner surface of the flange 13 when the latch member is moved outwardly to prevent permanent deformation of the resilient arm 50.

In seating the cover 12 on the can 10 as in FIGS. 1-4, the cover 12 when provided with a resilient stop member 21 is moved downwardly over the rim 11 with the outer edge 27 of the latch element as forming a camming surface on the latch element 25 and effect outwardly movement of the latch arm 22, thereby permitting the cover 12 to be moved downwardly over the rim 11. As soon as the latch element 25 rides over the rim 11, the resilient arm 22 moves inwardly so that the upper edge 28 of the latch element 25 will engage the lower surface of the rim 11 when the cover 12 is moved vertically upwardly. At the same time, the resilient stop element 21 rides over the rim 11 and is adapted to engage the lower surface of the rim 11 whenever the cover is moved upwardly. If a rigid stop element 21 is used, the stop element 21 is first placed in holding position on the can 10 with the upper inner end thereof in engagement with the lower surface of the rim 11 and thereafter the resilient latch means 20 is moved downwardly over the rim 11 so that the cover 12 is releasably held on the can 10. When removing the cover 12, the latch arm 22 is moved outwardly to disengage the latch element 25 from the rim 11, and the cover is pivotally moved upwardly.

I claim:

1. A releasable latch means for retaining a removable cover on a container of the type having an outwardly turned rim on the uppermost edge thereof and where the cover is of the type having a depending circumferential flange extending downwardly over the outwardly turned rim, said latch means comprising a stop element adapted to extend inwardly from said flange and engage the lower edge of said rim when the cover is moved upwardly, resilient latch means adapted to be secured to said flange in an area diametrically opposite said stop element, said latch means having a resilient latch arm adapted to extend longitudinally along the outer surface of said flange generally parallel to said flange and to being secured at one end to said flange and being provided at a point spaced from said one end with a latch element extending inwardly through said flange adapted to engage the lower edge of the rim of the container when the cover is moved upwardly and prevent accidental removal of said cover, said latch element lying in a vertical plane which is generally perpendicular to the plane of said latch arm and having an upper horizontal edge with a lower edge curved downwardly from the inner end of said latch element and outwardly to the longitudinally extending portion of said latch arm to provide a camming surface for contacting the surface of said rim and automatically moving said latch element outwardly over said rim into latching position when said cover is moved downwardly into closed position on the upper end of said container, and means associated with said resilient latch arm adapted for manually moving said latch arm outwardly in a horizontal plane away from said rim in order to move said latch element out of engagement with said rim when said cover is moved upwardly.

2. A resilient latch means as in claim 1, wherein said resilient latch arm has the end thereof opposite said one end spaced from the surface of said flange to provide said means for manually moving said latch arm outwardly.

3. A resilient latch means as in claim 1 or 2, wherein said resilient latch arm has said latch element formed thereon intermediate the ends thereof.

* * * * *